US010831140B2

(12) United States Patent
Matsuura et al.

(10) Patent No.: US 10,831,140 B2
(45) Date of Patent: Nov. 10, 2020

(54) IMAGE FORMING APPARATUS WITH DISPLAY OF STACKING METHOD IN WHICH ENVELOPE IS STACKED SO AS TO FIX IMAGE ON FLAP-FORMED SIDE OR ADDRESS PRINT SIDE

(71) Applicant: CANON KABUSHIKI KAISHA, Tokyo (JP)

(72) Inventors: Daigo Matsuura, Tokyo (JP); Yasuharu Chiyoda, Nagareyama (JP); Shigeru Tanaka, Tokyo (JP); Mitsuru Hasegawa, Tsukubamirai (JP); Yusuke Yamaguchi, Nagareyama (JP); Shigeru Hirano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/658,412

(22) Filed: Oct. 21, 2019

(65) Prior Publication Data

US 2020/0133184 A1 Apr. 30, 2020

(30) Foreign Application Priority Data

Oct. 24, 2018 (JP) ..... 2018-200392

(51) Int. Cl.
*G03G 15/00* (2006.01)

(52) U.S. Cl.
CPC ..... *G03G 15/5016* (2013.01)

(58) Field of Classification Search
CPC ..... G03G 15/5016
USPC ..... 399/81
See application file for complete search history.

(56) References Cited

U.S. PATENT DOCUMENTS 8,600,286 B2 12/2013 Chiyoda
10,578,999 B2 * 3/2020 Hirano et al. ..... G03G 15/5016

FOREIGN PATENT DOCUMENTS

JP 2007-271681 A 10/2007

* cited by examiner

*Primary Examiner* — William J Royer
(74) *Attorney, Agent, or Firm* — Venable LLP

(57) ABSTRACT

An image forming apparatus includes an image forming portion capable of forming a toner image on an envelope including a flap; a stacking portion configured to stack the envelope; a fixing portion configured to fix the toner image on the envelope; a display portion configured to display information; and a controller configured to control the display portion so that when a double-side mode in which the images are formed on the double sides of the envelope is selected, a stacking method in which the envelope is stacked on the stacking portion so as to fix the image on a flap-formed side when the envelope first passes through the fixing portion is displayed at the display portion.

10 Claims, 9 Drawing Sheets

IMAGE FORMING APPARATUS WITH DISPLAY OF STACKING METHOD IN WHICH ENVELOPE IS STACKED SO AS TO FIX IMAGE ON FLAP-FORMED SIDE OR ADDRESS PRINT SIDE

FIELD OF THE INVENTION AND RELATED ART

The present invention relates to an image forming apparatus, such as a printer, a copying machine, a facsimile machine or a multi-function machine using an electrophotographic type, in which a display device connected thereto is controlled.

In the image forming apparatus of the electrophotographic type or the like, a toner image is formed on a recording material at a transfer portion and thereafter the recording material is fed to a fixing device in order to fix the toner image on the recording material. When the recording material fed to the fixing device passes through a fixing nip formed by a fixing roller and a pressing roller, the toner image formed on the recording material is fixed on the recording material by being heated and pressed.

In recent years, the image forming apparatus is used for printing an image on, as a recording material, an envelope in addition to sheets such as plain paper, thick paper, rough paper, embossed paper and coated paper (Japanese Laid-Open Patent Application (JP-A) 2007-271681). In the image forming apparatus disclosed in JP-A 2007-271681, a pressure of the fixing nip (nip pressure) is changed between the case where the image is printed on the plain paper and the case where the image is printed on the envelope.

However, conventionally, in the case where the images are printed on double (both) sides of the envelope, printing of the images on the envelope was not properly carried out in some instances such that characters or the like were printed obliquely on the envelope. This is because the envelope is not fed to the transfer portion in a proper attitude, and this phenomenon is particularly conspicuous when the image is printed on a second (surface) side which is liable to be influenced by heating and pressing of the envelope for fixing of the toner image on a first (surface) side. Therefore, for example, in the case where an envelope on which a field or the like in which for example a postal code is filled (printed) has been printed in advance is used for double-side printing, when the second side is an address (surface) side of the envelope, oblique printing is liable to be conspicuous. Therefore, an image forming apparatus such that an envelope stacking method in which printing of the image on the address side of the envelope is properly carried out during double-side printing is displayed at a display portion connected to the image forming apparatus has been desired, but such an image forming apparatus has not yet been proposed.

SUMMARY OF THE INVENTION

A principal object of the present invention is to provide an image forming apparatus capable of properly carrying out printing of an image on an address side of an envelope during double-side printing.

According to an aspect of the present invention, there is provided an image forming apparatus comprising: an image forming portion capable of forming a toner image on an envelope including a flap and capable of executing an operation in a one side mode in which an image is formed on one side of a recording material and an operation in a double side mode in which images are formed on double sides of the recording material; a stacking portion configured to stack the envelope fed to said image forming portion; a fixing portion configured to fix the toner image on the envelope, on which the toner image is formed by said image forming portion, by heating and pressing the envelope; a display portion configured to display information; and a controller configured to control said display portion so that when the double-side mode in which the images are formed on the double sides of the envelope is selected, a stacking method in which the envelope is stacked on said stacking portion so as to fix the image on a flap-formed side when the envelope first passes through said fixing portion is displayed at said display portion.

Further features of the present invention will become apparent from the following description of exemplary embodiments with reference to the attached drawings.

Figure 7:
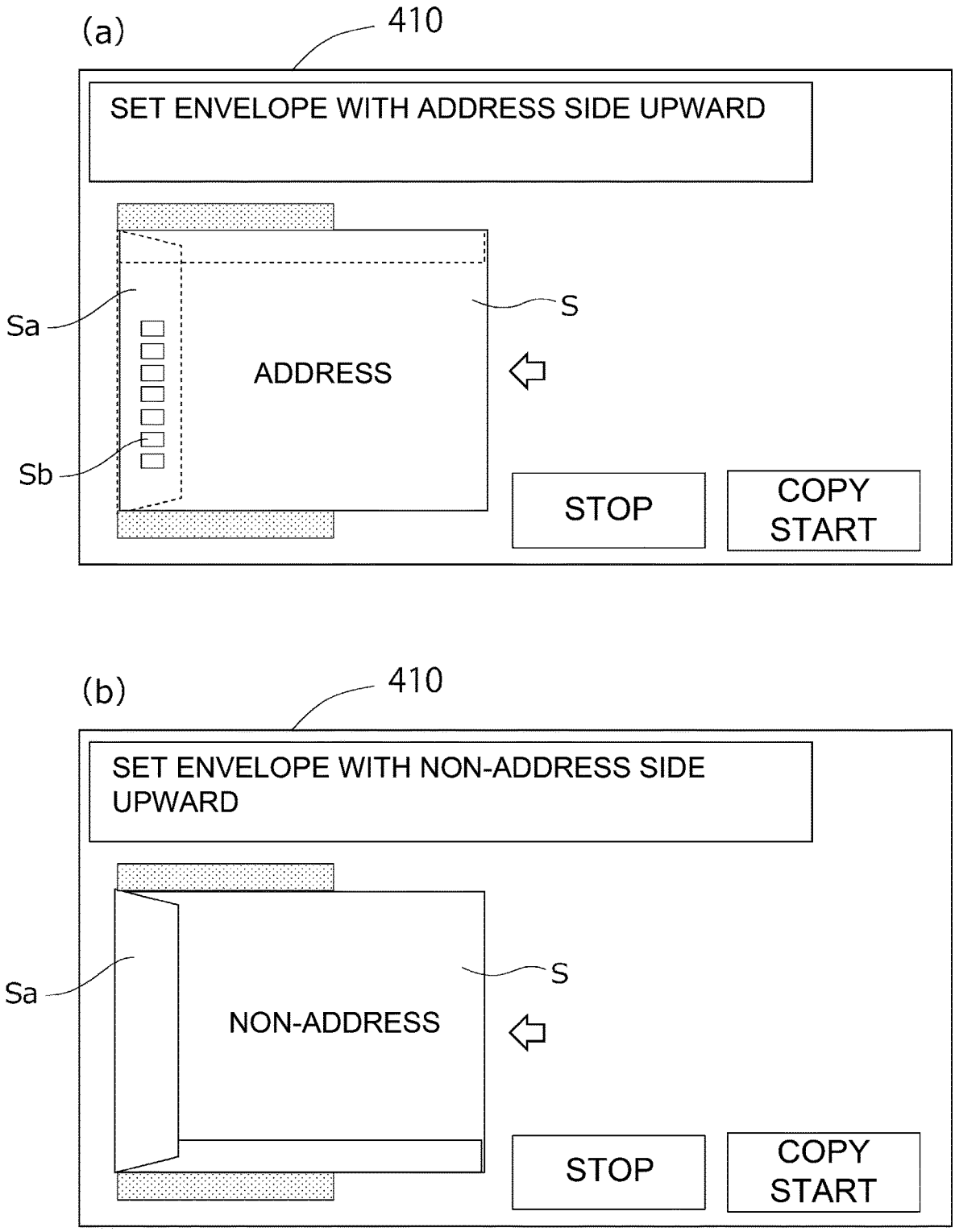

Part (a) of FIG. 7 is a schematic view showing a display of an envelope in the case where the envelope is stacked on a manual feeding tray and part (b) of FIG. 7 is a schematic view having a display of an envelope in the case where the envelope is stacked on a cassette.

Figure 8:
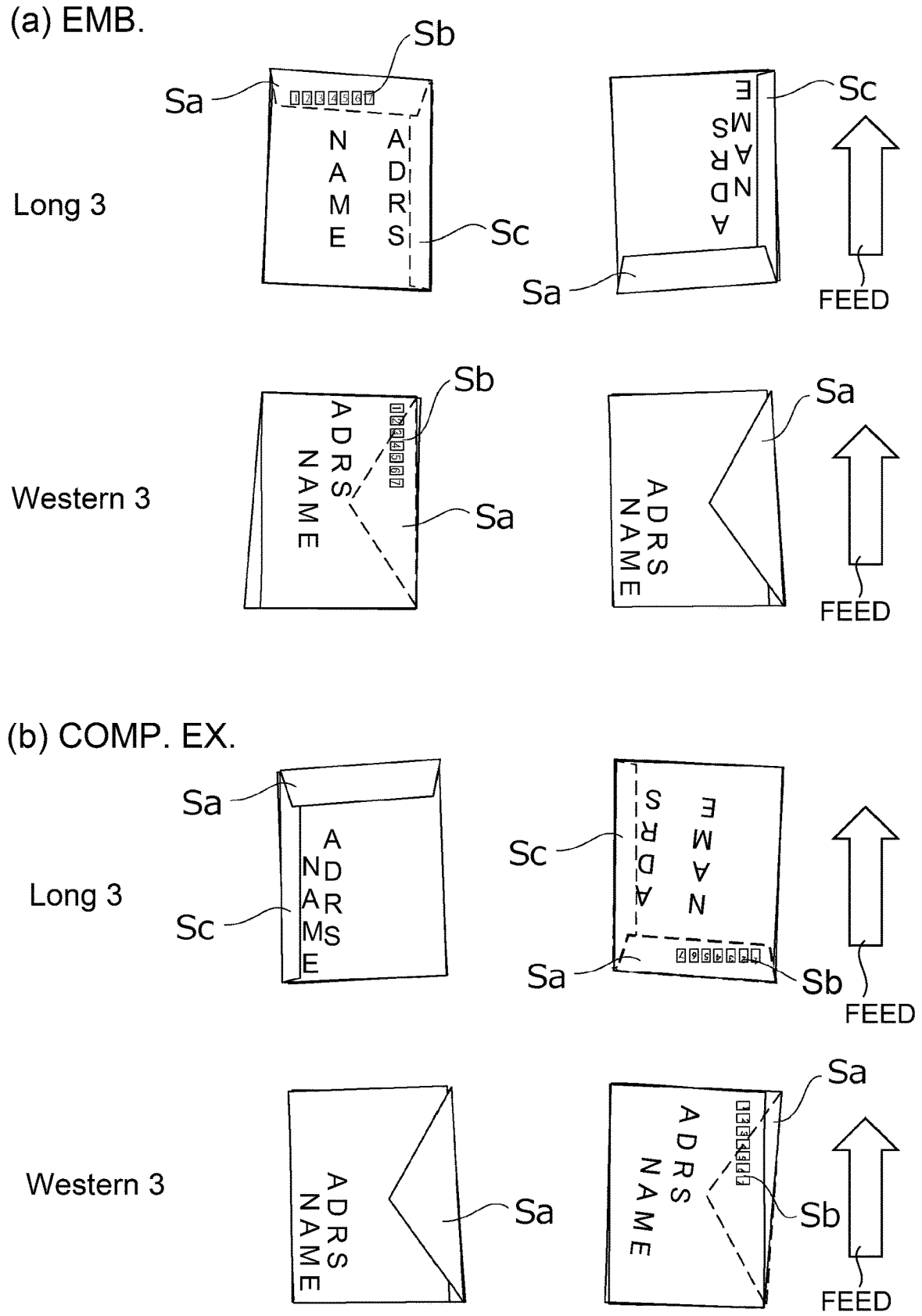

Parts (a) and (b) of FIG. 8 are schematic views each showing a display of an envelope in the case where the envelope is stacked on a manual feeding tray, in which part (a) shows the embodiment comparison example.

Figure 9:
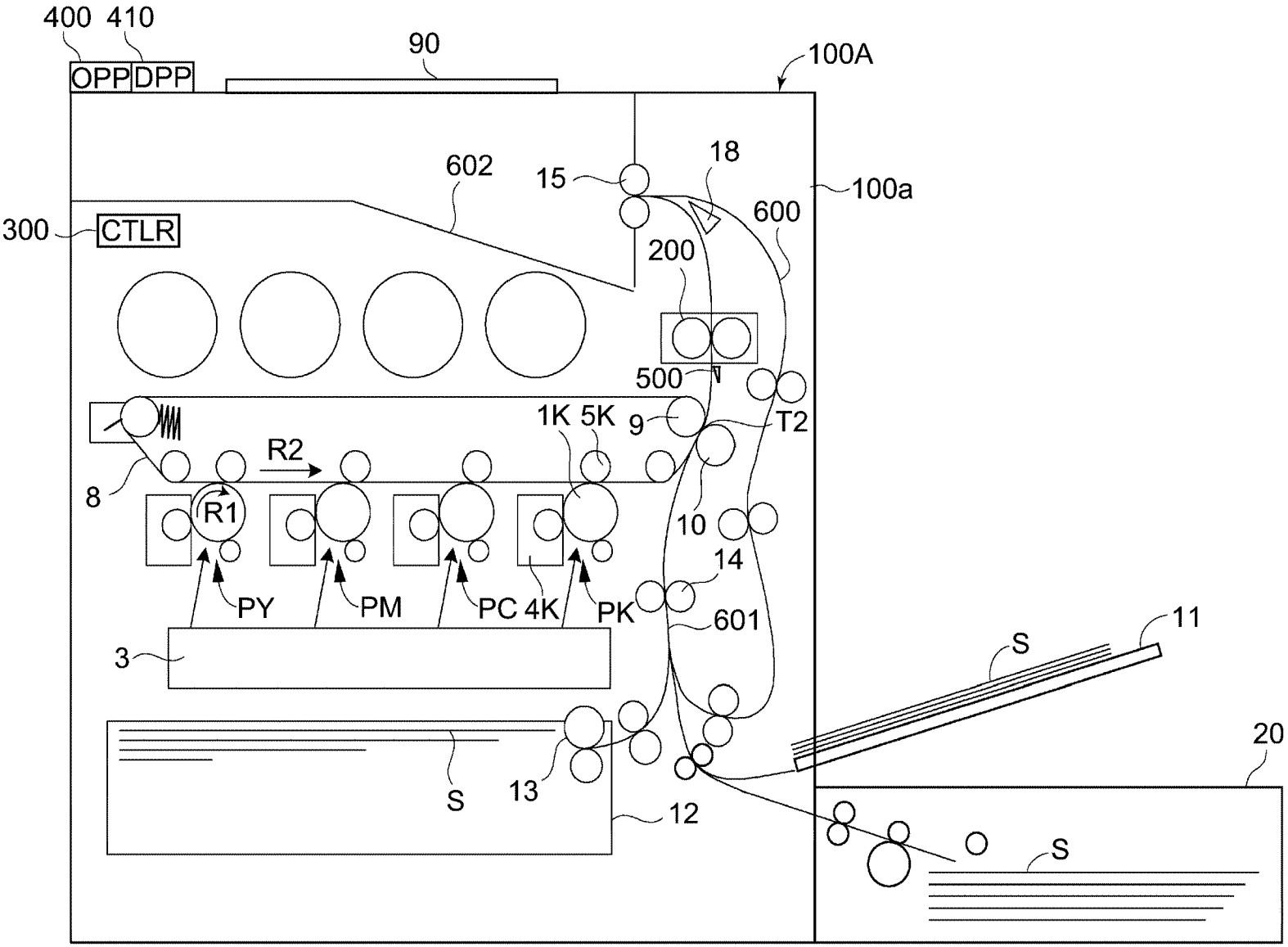

FIG. 9 is a schematic view showing an image forming apparatus of a vertical feeding type to which a control device in the embodiment is applicable.

DESCRIPTION OF EMBODIMENTS

<Image Forming Apparatus>

Figure 1:
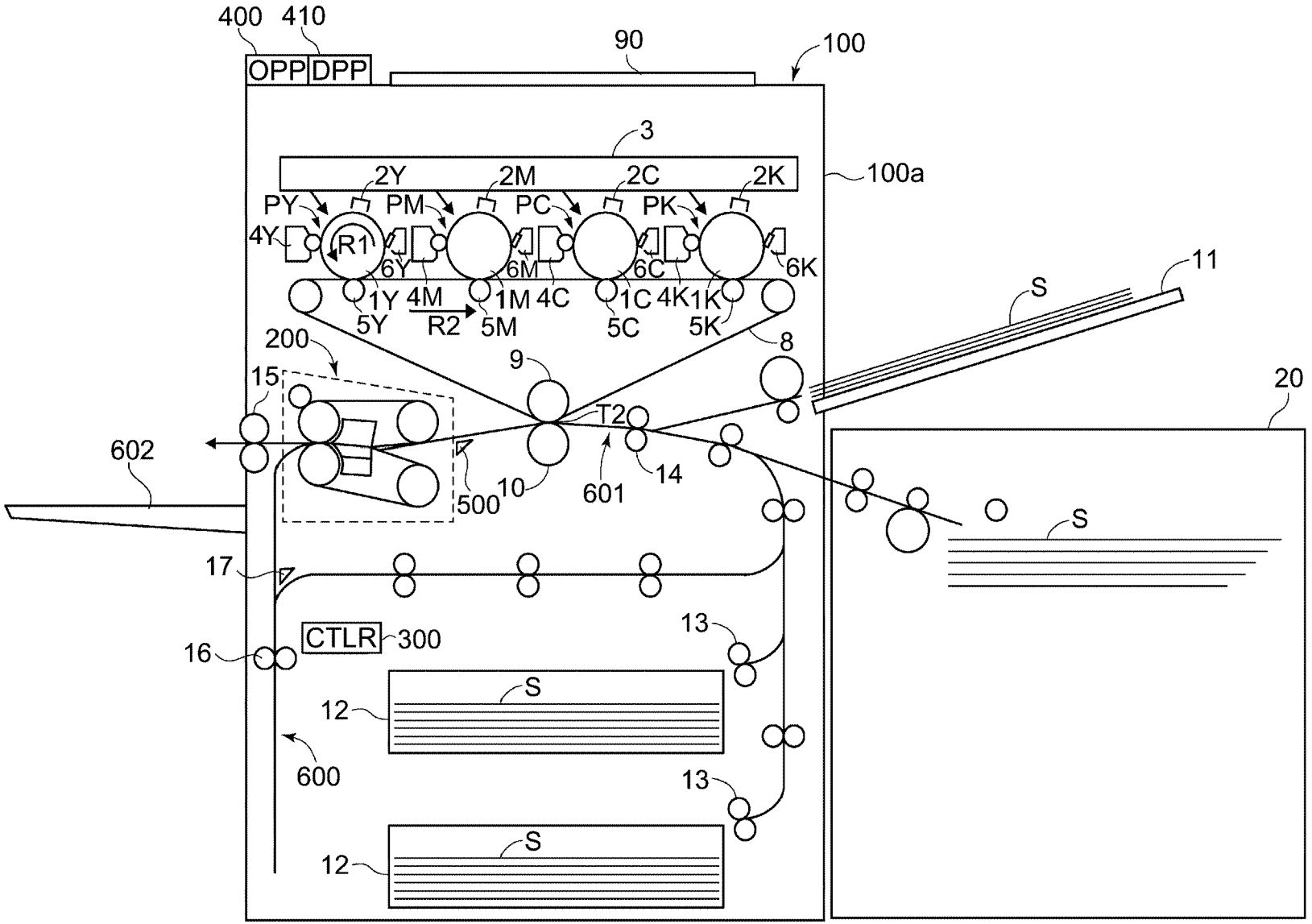
FIG. 1 is a schematic view showing an image forming apparatus of a lateral feeding type to which a control device in an embodiment is applicable.

A control device in an embodiment will be described. First, an image forming apparatus of a lateral (horizontal) feeding type to which the control device in this embodiment is applicable will be described using FIG. 1. An image forming apparatus 100 shown in FIG. 1 is a tandem full-color printer of an electrophotographic type. The image forming apparatus 100 includes image forming portions PY, PM, PC and PK for forming images of yellow, magenta, cyan and black, respectively. The image forming apparatus 100 forms a toner image on a recording material depending on an image signal from an original reading device 90 connected to an apparatus main assembly 100*a* or from an external device, such as a personal computer, communicatably connected to the apparatus main assembly 100*a*. In this embodiment, the image forming apparatus 100 is capable of forming the toner image on an envelope S which is the recording material.

As shown in FIG. 1, the image forming portions PY, PM, PC and PK are arranged in the apparatus main assembly 100*a* along a movement direction of an intermediary transfer belt 8. The intermediary transfer belt 8 is stretched by a plurality of rollers and is constituted so as to travel in an arrow R2 direction. The intermediary transfer belt 8 carries and feeds toner images which are primary-transferred thereon. At a position opposing, through the intermediary transfer belt 8, a secondary transfer inner roller 9 for stretching the intermediary transfer belt 8, a secondary transfer outer roller 10 is provided and constitutes a secondary transfer portion T2 where the toner images are transferred from the intermediary transfer belt 8 onto the envelope S. On a side downstream of the secondary transfer portion T2 with respect to a recording material feeding direction, a fixing device 200 is provided. Incidentally, in the case of this embodiment, the image forming portion PY to PK, the intermediary transfer belt 8, the secondary transfer inner roller 9 and the secondary transfer outer roller 10 are an example of an image forming unit capable of forming the toner image on the envelope S.

At a lower portion of the image forming apparatus 100, a cassette 12 in which envelopes S are stacked. Each of the envelopes S is supplied from the cassette 12 to a feeding passage 601 by a feeding roller pair 13. Thereafter, a registration roller pair 14 is started to be rotated in synchronism with the toner images formed on the intermediary transfer belt 8 as described later. When the envelope S is fed to the registration roller pair 14 disposed at an intermediary portion of the feeding passage 601, oblique movement correction and timing correction of the envelope S are made by the registration roller pair 14, and thereafter, the envelope S is sent to the secondary transfer portion T2.

Incidentally, the cassette 12 may also be provided in plurality so that envelopes different in size and thickness can be stacked on the plurality of cassettes 12, and in that case, the envelope S is selectively fed from either one of the plurality (two in this embodiment) of cassettes 12. Further, the envelope S is not limited to the envelopes S stacked on the cassettes 12, and the envelope S stacked on a manual feeding tray 11 may also be fed or the envelope S stacked in a stacking device 20 connected to the apparatus main assembly 100*a* may also be fed. Incidentally, in this embodiment, as a feeding manner, the envelope S on the manual feeding tray 11 or in the stacking device 20 (corresponding to a first stacking portion) is fed to the secondary transfer portion T2 while being kept in a stacked state so that the toner image is formed on an upper surface side. On the other hand, the envelope S in the cassette 12 (corresponding to a second stacking portion) is fed to the secondary transfer potion T2 while being in a stacked state so that the toner image is formed on a lower surface side.

The four image forming portions PY, PM, PC and PK substantially have the same constitution except that development colors are different from each other. Accordingly, in this embodiment, as a representative, the image forming portion PY for yellow will be described, and other image forming portions will be omitted from description. In the image forming portion PY, a photosensitive drum 1Y is provided. The photosensitive drum 1Y is rotationally driven in an arrow R1 direction. At a periphery of the photosensitive drum 1Y, a charging device 2Y, an exposure device 3, a developing device 4Y, a primary transfer roller 5Y and a cleaning device 6Y are provided. 1M, 1C, and 1K are photosensitive drums; 2M, 2C, and 2K are charging devices; 4M, 4C, and 4K are developing devices; 5M, 5C, and 5K are primary transfer rollers; and 6M, 6C, and 6K are cleaning devices.)

In the case where an image forming operation is started, first, a surface of the rotating photosensitive drum 1Y is electrically charged uniformly by the charging device 2Y. The charging device 2Y is, for example, a corona charger for charging the photosensitive drum 1Y uniformly to a negative dark-portion potential by irradiating the photosensitive drum 1Y with charged particles with corona discharge. Then, the photosensitive drum 1Y is subjected to scanning exposure to laser light, corresponding to an image signal, emitted from the exposure device 3. As a result, an electrostatic latent image depending on the image signal is formed on the surface of the photosensitive drum 1Y. The electrostatic latent image formed on the photosensitive drum 1Y is visualized by toner (developer) accommodated in the developing device 4Y, so that the toner image which is a visible image is formed.

The toner image formed on the photosensitive drum 1Y is primary-transferred onto the intermediary transfer belt 8 at a primary transfer portion constituted between the photosensitive drum 1Y and the intermediary transfer belt 8 urged by the primary transfer roller 5Y. At this time, to the primary transfer roller 5Y, a primary transfer bias is applied. The toner remaining on the surface of the photosensitive drum 1Y after the primary transfer is removed by the cleaning device 6Y.

Such an operation is successively performed in the respective image forming portions PY to PK for yellow, magenta, cyan and black, respectively, so that four color toner images are superposed on each other. Therefore, in synchronism with toner image formation, the envelope S stacked on the manual feeding tray 11, the cassette 12 or the stacking device 20 is fed to the secondary transfer portion T2 through the feeding passage 601. Then, by applying a secondary transfer bias to the secondary transfer outer roller 10, a full-color toner image formed on the intermediary transfer belt 8 is secondary-transferred onto the envelope S.

Then, the envelope S passed through the secondary transfer roller T2 is supported by a guiding member 500 and is fed toward the fixing device 200. The guiding member 500 guides the envelope S toward the fixing device 200 while supporting the envelope S on a side opposite from a side where the toner image is formed during passing of the envelope S through the secondary transfer portion T2 immediately before guidance of the envelope S by the guiding member 500. In the fixing device 200 as a fixing portion, the toner image is heated and pressed with nip-feeding of the envelope S, so that the toner image is fixed on the envelope S.

<Fixing Device>

Figure 2:
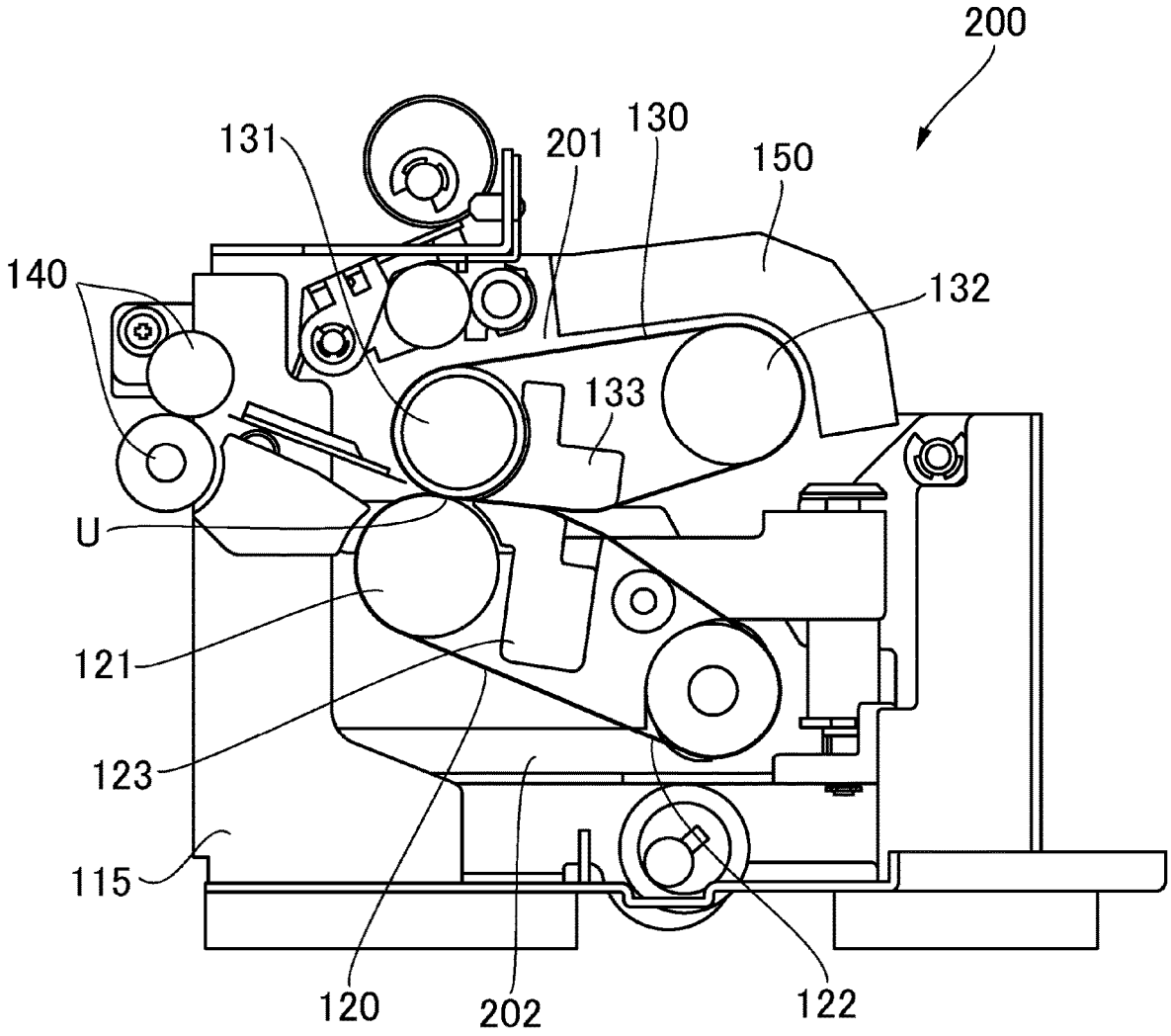
FIG. 2 is a schematic view showing an example of a fixing device.

The fixing device 200 will be described using FIG. 2. The fixing device 200 shown in FIG. 2 is a fixing device of a twin belt type. This fixing device 200 forms a fixing nip U by causing an endless pressing belt 120 assembled with a lower frame 202 to be press-contacted to an endless heating belt 130 assembled with an upper frame 201. The heating belt 130 is extended around a driving roller 131 and a tension roller 132, which are shaft-supported by a frame 115, with predetermined tension, and is circulated and rotated by rotation of the driving roller 131. The driving roller 131 has a function of generating pressure at the fixing nip U by supporting an inner surface of the heating belt 130, and the tension roller 132 has a function of imparting belt tension to the heating belt 130. Inside the heating belt 150, a fixing pad 133 formed of stainless steel, for example, is provided. The fixing pad 133 presses the heating belt 130 toward a pressing pad 123 with predetermined pressure, and thus forms the fixing nip U in combination with the driving roller 131.

In the fixing device 200, the heating belt 130 is heated by an induction heating device 150 (for example, an IH heater)

through electromagnetic induction heating. The induction heating device 150 is provided so as to provide a predetermined gap between itself and another peripheral surface of the heating belt 130. The induction heating device 150 includes, although omitted from illustration, for example, an exciting coil prepared by winding electric wire such as Litz wire, and an outside magnetic core. The exciting coil generates an AC magnetic field (magnetic flux) when an alternating current is applied thereto. The exciting coil generates the AC magnetic field, so that the heating belt 130 is induction-heated. Further, in order to induction-heat the heating belt 130 efficiently, the outside magnetic core, formed with a high-permeability member such as ferrite capable of shielding the AC magnetic field, is provided so as to cover the exciting coil.

On the other hand, the pressing belt 120 is extended around a pressing roller 121 shaft-supported by the lower frame 202 and a tension roller 122 with predetermined tension and is rotated by the rotation of the heating belt 130. Inside the pressing belt 120, the pressing pad 123 formed of a silicone rubber, for example, is disposed. The pressing pad 123 presses the pressing belt 120 toward the fixing pad 133 with predetermined pressure, and thus forms the fixing nip U in combination with the pressing roller 121. Then, when the envelope S passes through the fixing nip U, the envelope S is discharged to an outside of the fixing device 200 by a fixing discharging roller pair 140.

Returning to FIG. 1, the image forming apparatus 100 is capable of printing images on both sides (surfaces) of the envelope S. In the case of one-side printing, the envelope S on which the toner image is fixed on one side thereof is discharged by a discharging roller pair 15 on a discharge tray 602 provided outside the apparatus main assembly 100*a*. On the other hand, in the case of double-side printing, the envelope S on which the toner image is fixed on a first (one) side is fed by a normally rotating feeding roller pair 16 toward a double-side feeding passage 600 in order to form a toner image on a second side subsequently to the fixing of the toner image on the first side. Then, the feeding roller pair 16 is reversely rotated with timing when a trailing end of the envelope S with respect to a recording material (envelope) feeding direction reaches a switching portion 17. Leading and trailing ends of the envelope S are changed to each other in the double-side feeding passage 600 by the reverse rotation of the feeding roller pair 16 and is fed again along the feeding passage 601 toward the registration roller pair 14 (so-called, switch-back feeding). In this case, the envelope S to be fed again along the feeding passage 601 is switched (reversed) between the first side and the second side thereof so that the other side (the second side opposite from the first side) where the toner image is not fixed at the secondary transfer portion T2 faces toward the intermediary transfer belt 8 side. Thereafter, the envelope S is subjected to the process similar to the process in the case of the one-side printing, and thus the toner image is fixed on the second side thereof, and then is discharged by the discharging roller pair 15 on the discharge tray 602 disposed outside the apparatus main assembly 100*a*. Incidentally, a portion constituted by the double-side feeding passage 600, the discharging roller pair 15 and the switching portion 17 is an example of an automatic feeding mechanism for automatically reversing the envelope S.

<Controller>

Figure 3:
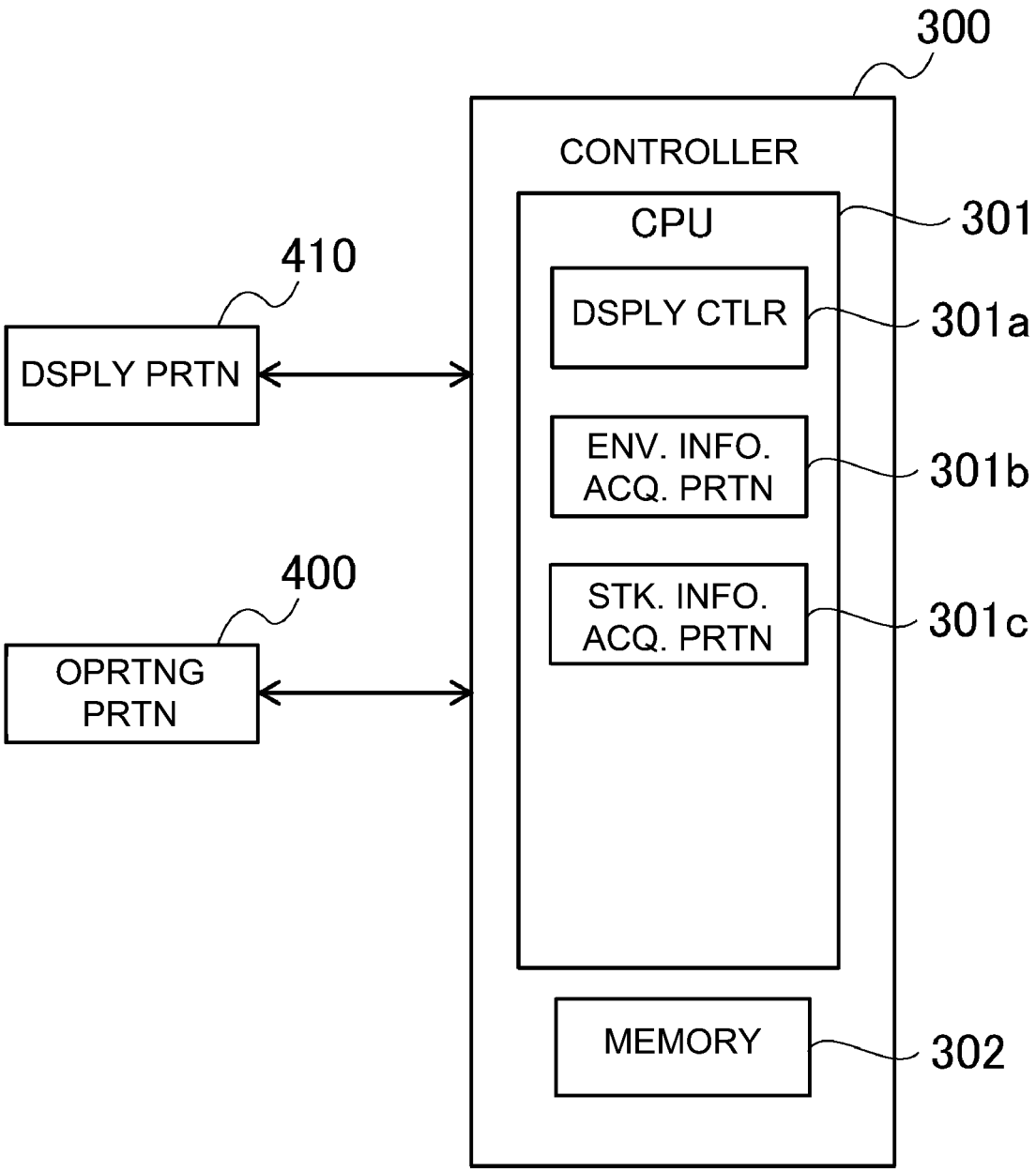
FIG. 3 is a control block diagram for illustrating a controller.

As shown in FIG. 1, the image forming apparatus 100 of this embodiment includes a controller 300 as a controlling device. The controller 300 will be described using FIG. 3. As shown in FIG. 3, the controller 300 includes a CPU 301 (central processing unit) and a memory 302 such as a ROM (read only memory) or a RAM (random access memory). In the memory 302, for example, various programs such as a display control program (FIG. 8 described later) and an image forming job, and various data such as envelope information and stacking portion information which are described later, and image data read by the original reading device 90 and the like are capable of being stored. The CPU 301 is capable of executing the various programs stored in the memory 302. Incidentally, the memory 302 is also capable of temporarily storing a calculation process result with execution of the various programs.

In the case of this embodiment, the CPU 301 is capable of carrying out display control of a display portion 410 connected to the image forming apparatus 100 by executing the display control program in advance of execution of the image forming job. Incidentally, the display control program is not limited to the form of a software program, but may also be executable in the form of a micro program processed by a DSP (digital signal processor), for example. That is, as regards the CPU 301, one for carrying out various pieces of control such as an image forming operation by executing a control program such as the image forming job may also be used in combination, but the CPU 301 is not limited thereto. A CPU prepared exclusively for executing the display control program may also be used.

To this CPU 301, an operating portion 400 and the display portion 410 are connected via communication busses (for example, data and address busses). The operating portion 400 is, for example, an operating panel, an external terminal or the like for receiving an execution start operation, by a user, of the various programs such as the image forming job and receiving various data inputting operations by the user and the like operation. The operating portion 400 includes, as described later (FIG. 4), various operating elements such as operating keys and operating buttons through which the operating portion 400 receives user's input. The display portion 410 is capable of appropriately displaying various screens such as an input screen (FIG. 5) for inputting various data relating to the envelope S on which the image is printed. In the case of this embodiment, the operating portion 410 is a display of a so-called touch panel type in which various phantom operating elements are displayed and input of various data by the user depending on a touch operation to the phantom operating elements by the user. Incidentally, the display portion 410 is not limited to the display provided to the apparatus main assembly 100*a*, but may also be, for example, an external display connected to the apparatus main assembly 100*a* or a display of an external terminal such as a personal computer. Further, the display portion 410 may also be connected to the image forming apparatus 100 through cable (wire) connection or wireless connection if the display portion 410 is capable of communicating with the image forming apparatus 100.

<Operating Portion>

Figure 4:
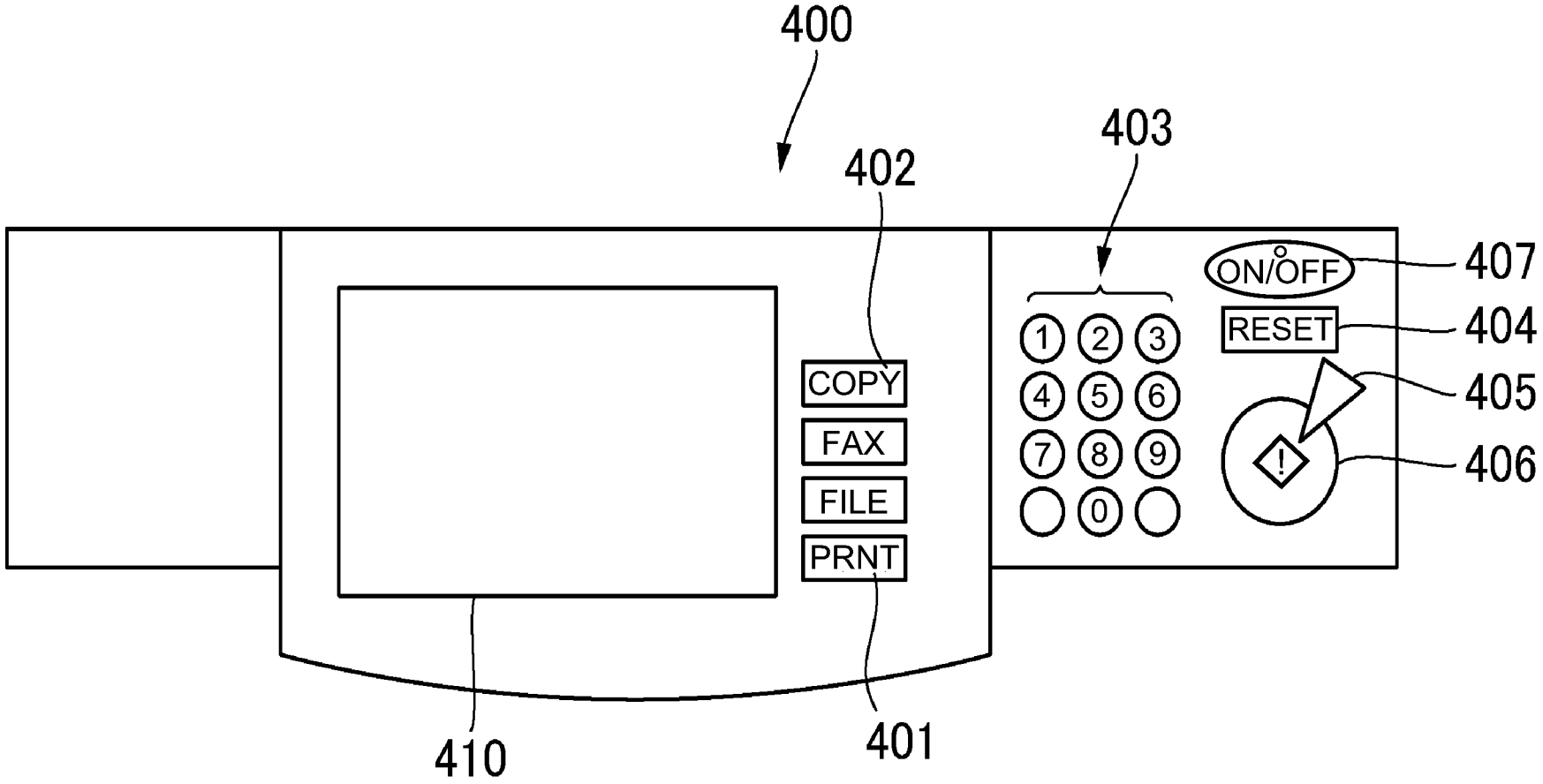
FIG. 4 is a schematic view showing an operating portion.

FIG. 4 shows an example of the operating portion 400. As shown in FIG. 4, the operating portion 400 is provided with various operating elements such as a printer key 401, a copy mode key 402, a numeric keypad 403, a reset key 404, a stop key 405, a start key 406, and a power (on/off) switch 407. The printer key 401 is used for inputting various data relating to normal printing. The copy mode key 402 is used for inputting various data relating to copy printing in the case where the image forming apparatus 100 is used as a copying machine (copy mode). In the case where the printer key 401 or the copy mode key 402 are operated, for example, an input screen for inputting the various data is displayed at the display portion 410. The numeric keypad 403 is used for inputting information on a numerical value such as print number, for example. The reset key 404 is used for resetting inputted various data by operation of the respective keys, to initial values. The stop key 405 is used for forcedly stopping the image forming job during execution, for example. The start key 406 is used for providing on instruction to start the execution of the image forming job including a reading operation of an original image during an operation in a copy mode). The power switch 407 is an on/off switch used for turning on a power source of the image forming apparatus 100 from an off state or for turning of the power source from an on state. The image forming apparatus 100 is operable in a state in which the power source is turned on.

<Input Screen>

Figure 5:
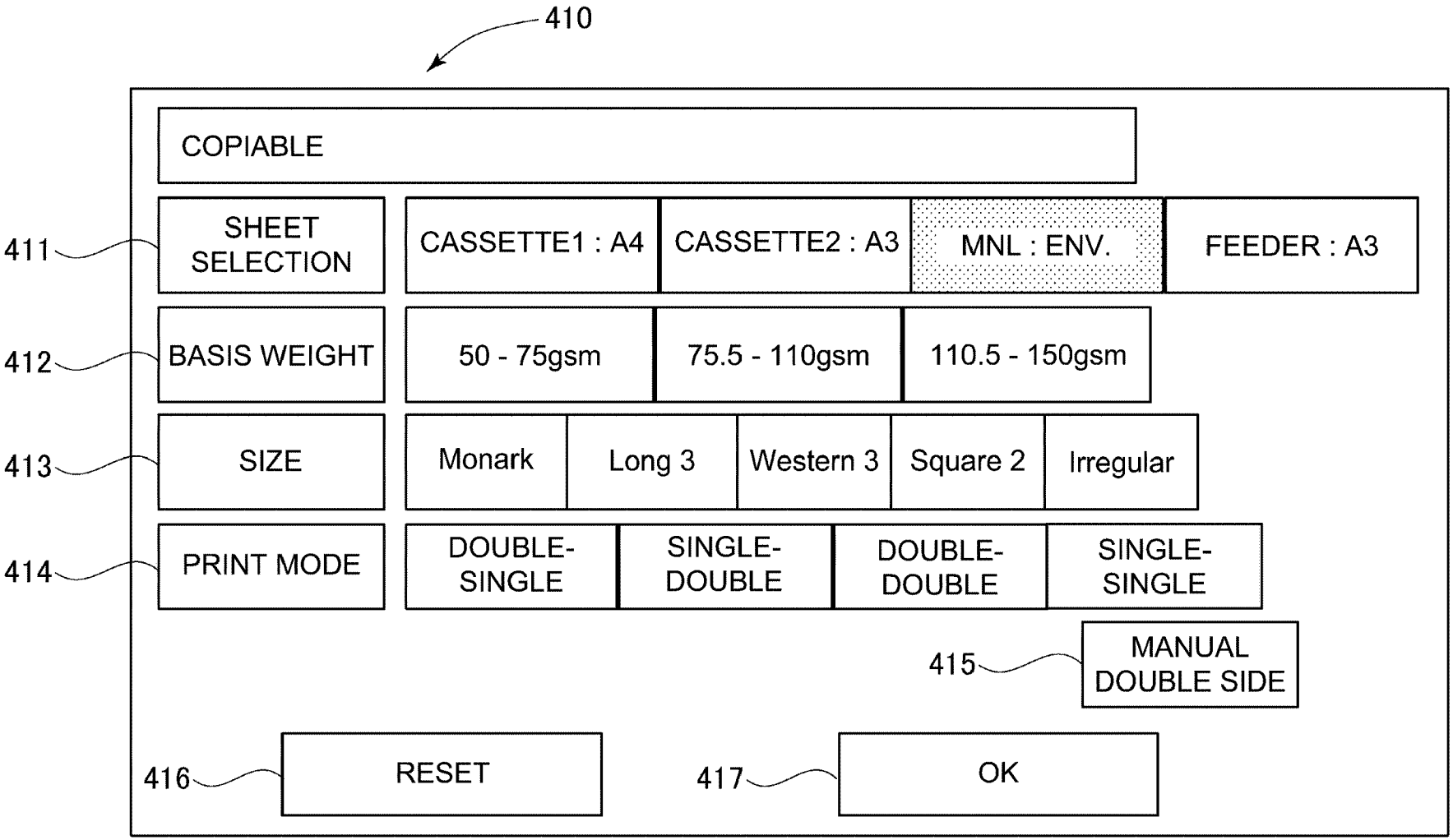
FIG. 5 is a schematic view showing an input screen.

FIG. 5 shows an example of an input screen displayed at the display portion 410. However, in FIG. 5, the case where the image forming apparatus 100 is used as the copying machine (copy mode) was shown as an example. In order to indicate the copy mode, on the input screen shown in FIG. 5, "COPIABLE" is displayed. On this input screen, as the phantom operating elements, a sheet selection key 411, a basis weight selection key 412, a size selection key 413, a print mode key 414, a manual double side (printing) key 415, a reset (setting release) key 416, an OK key 417 are displayed. The user is capable of selectively inputting the various data relating to the printing by using these phantom operating elements displayed at the display portion 410. These phantom operating keys are reverse-displayed every operation by the user. As a result, the user can know that selection of information on display contents associated with the operated phantom operating element was made. Incidentally, the phantom operating elements shown in FIG. 5 are an example, and are not limited thereto.

The sheet selection key 411 is used for inputting either one of the cassette 12, the manual feeding tray 11 and the stacking device (sheet feeding device) 20. Either one of the cassette 12, the manual feeding tray 11 and the stacking device 20 (hereinafter, these are also referred to as stacking portions) inputted by the sheet selection key 411 is stored in the memory 302 (FIG. 3). In this example, the case where "MANUAL FEEDING TRAY: ENVELOPE" is selected for stacking the envelope S on the manual feeding tray 11 and for printing the image on the surface was shown.

The basis weight selection key 412 is used for inputting a basis weight of the envelope S. The size selection key 413 is used for inputting a size (kind) of the envelope S stacked on the stacking portion inputted by the sheet selection key 411. In this example, as the size of the envelope S stacked on the manual feeding tray 11, it is possible to input either one of "Monark, Long 3, Western 3, Square 2, Irregular". Incidentally, "Irregular" is inputted as the size of the envelope S, the user input an arbitrary size by using the numeric keypad 403 (FIG. 4) or the like. The thus-inputted size of the envelope S is stored as envelope information in the memory 302.

The print mode key 414 is used for inputting either one of a one (single) side printing mode in which the image is printed on only one (single) side of the recording material and a double-side printing mode in which the images are printed on both (double) sides of the recording material. The user is capable of selecting the one-side printing mode in which the images on both sides of an original are printed on one side of the recording material ("DOUBLE-SINGLE") or in which the image on one side of the original is printed on one side of the recording material ("SINGLE-SINGLE") and the double-side printing mode in which the image on one side of the original is printed on both sides of the recording material ("SINGLE-DOUBLE") or in which the images on both sides of the original are printed on both sides of the recording material ("DOUBLE-DOUBLE"). The manual double side key 415 will be specifically described later. The reset key 416 is used for resetting (releasing) the information inputted by the operation of each of the above-described keys. The OK key 417 is used for determining the information inputted by the operation of each of above-described keys.

Returning to FIG. 3, the CPU 301 acquires various data inputted through the operating portion 400 and the display portion 410 and causes the memory 302 to store the various data. Then, for example, depending on an actuating operation such as turning-on of the power source (main switch) of the image forming apparatus 100, the CPU 301 reads the display control program (FIG. 8) from the memory 302 and executes the display control program. By executing the display control program, the controller 300 functions as a display controller 301*a*, an envelope information acquiring portion 301*b* and a stacking portion information acquiring portion 301*c*.

The display controller 301*a* controls display at the display portion 410. As display control of the display portion 410, the display controller 301*a* not only causes the display portion 410 to display the above-described input screens but also carries out display control such that in the case where the double-side printing of the images on the double sides of the envelope S is carried out, a stacking method of the envelope S the manual feeding tray 11, the cassette 12, and the stacking device 20 is displayed at the display portion 410. The envelope information acquiring portion 301*b* acquires envelope information, such as the size of the envelope S, inputted at the operating portion 400 or the display portion 410 and causes the memory 302 to store the enter information. The stacking portion information acquiring portion 301*c* acquires the stacking portion information of the manual feeding tray 11, the cassette 12 or the stacking device 20, on which the envelope S inputted at the display portion 410 is stacked, and causes the memory 302 to store the stacking portion information. The display controller 301*a* causes the display portion 410 to display the stacking method of the envelope S on the basis of the enter information and the stacking portion information which are acquired by the enter information acquiring portion 301*b* and the stacking portion information acquiring portion 301*c*, respectively.

Incidentally, conventionally, in the case where images are printed on double (both) sides of the envelope S, printing of the image on an address (surface) side was not properly carried out in some instances such that characters are obliquely printed. This is because the envelope S does not enter the secondary transfer portion T2 (FIG. 1) in a proper attitude. That is, the envelope S is formed in a bag shape by gluing or the like, so that the envelope S includes portions different in thickness (that is, compared with general-purpose paper, the envelope S has unevenness). In order to fix the toner image on the uneven envelope S, there is a need to sufficiently heat and press the envelope S in the fixing nip U while following the unevenness of the envelope S. However, in some instances, a heating temperature is excessively high and a pressing force (pressure) is excessively large, so that the envelope S was liable to cause distortion, twist or the like with toner image fixation depending on a gluing position of the envelope S, asymmetry of the flap, orientation of paper forming the envelope S, or the like.

Further, during double-side printing, in the case where the distortion or the twist occurs in the envelope S after the toner image is fixed on the first side of the envelope S, when the envelope S is sent to the secondary transfer portion T2 in order to print the toner image on the second side of the envelope S, the oblique movement correction by the registration roller pair 14 is not readily carried out appropriately. Then, the envelope S does not enter the secondary transfer portion T2 in a proper attitude, so that the toner image such as a character can be obliquely formed on the envelope S. As will be described later, in the case where an envelope on which a logo, an advertisement, or the like of an enterprise has been printed on the address side thereof was used for double-side printing, a postal code was deviated from a postal code field or an address was obliquely printed in some instances.

Therefore, in view of the above-described point, in this embodiment, a stacking method of the envelope S in which printing of the image on the address side is easily carried out so that the user can make reference to the stacking method in advance of the double-side printing of the envelope S, is displayed at the display portion 410. In the following, a display control process in this embodiment in which such display control is carried out will be described.

<Display Control Process>

Figure 6:
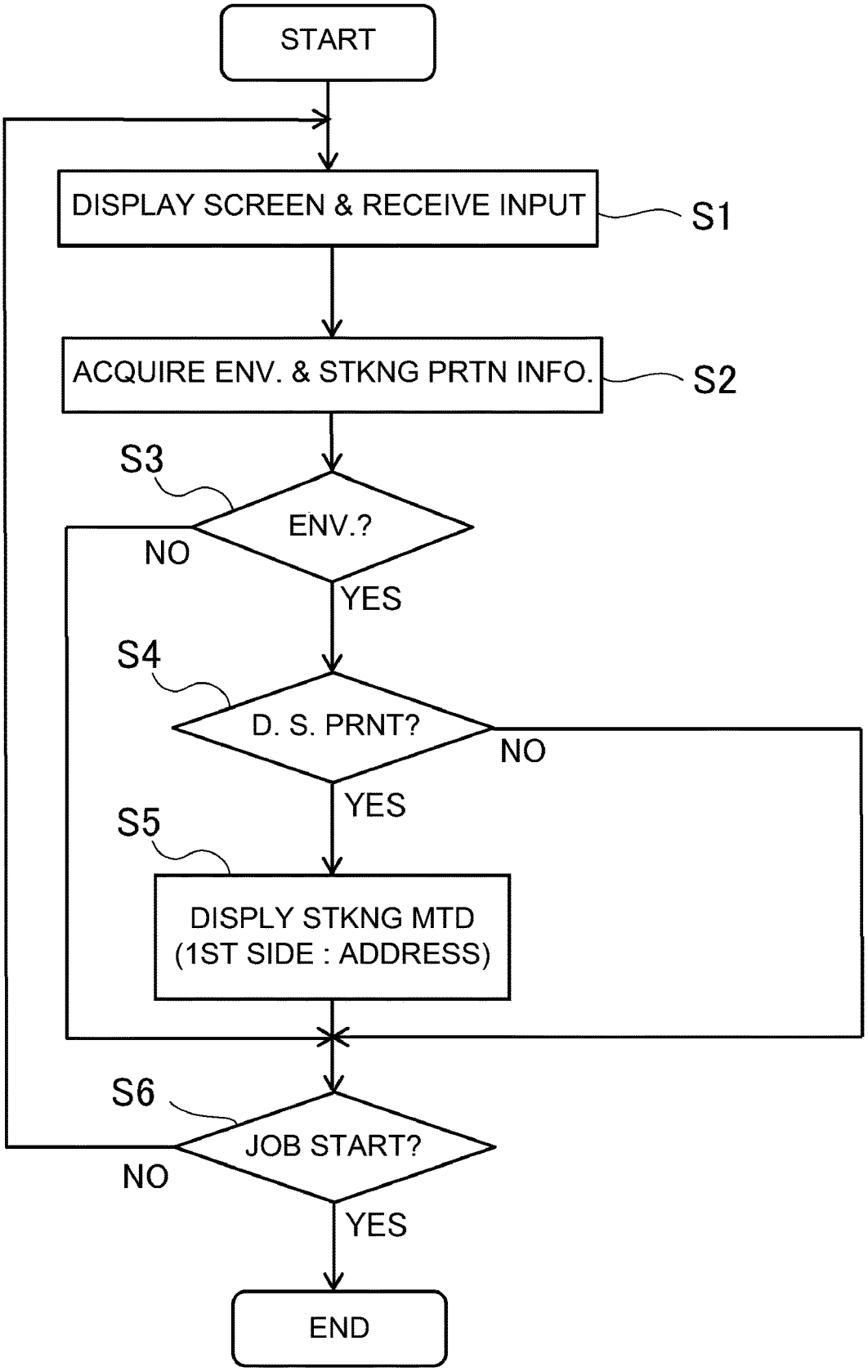
FIG. 6 is a flowchart showing a display control process in the embodiment.

The display control process in this embodiment will be described using FIG. 6 with reference to FIGS. 1 to 5. The display control process in this embodiment is started by the controller 300, for example, in the case where the printer key 401 or the copy mode key 402 of the operating portion 400 is operated by the user, and is ended in the case where the start key 406 of the operating portion 400 is operated, i.e., in response to a start of an image forming job.

The controller 300 causes the display portion 410 to display the above-described input screen (FIG. 5) or the like and receives user input through the displayed input screen (51). In response to the user input, the controller 300 is capable of acquiring envelope information as a procedure of acquiring the envelope information by the envelope information acquiring portion 301*b* and of acquiring stacking portion information as a procedure of acquiring the stacking portion information by the stacking portion information acquiring portion 301*c* (S2). The controller 300 discriminates whether or not the recording material subjected to printing is the envelope (S3). In the case where the recording material is not the envelope S (NO of S3), the controller 300 causes the process to jump to step S6.

In the case where the recording material is the envelope S (YES of S3), the controller 300 discriminates whether input is made through the input screen so that the image forming job is executed in an operation in which one of a double-side printing mode and an one-side printing mode (S4). In the case where the one-side printing mode is inputted (NO of S4), the controller 300 causes the process to jump to step S6. On the other hand, in the case where the double-side printing mode is inputted (YES of S4), the controller 300 causes the display portion 410 to display, as the procedure of displaying the stacking method of the envelope S, a "stacking method during double-side printing" including an envelope image (S5). In the case of this embodiment, as specifically described later (part (a) of FIG. 7), as the "stacking method during double-side printing", a stacking method in which the image is first printed on the address side (flap-formed side) as the first side is displayed at the display portion 410. Thereafter, the controller 300 discriminates whether or not an instruction to start the image forming job is provided (S6). In the case where the instruction to start the image forming job is not provided (NO of S6), the controller 300 repeats the above-described processes of 51 to S5. In the case where the instruction to start the image forming job is provided (YES of S6), the controller 300 ends the display control process.

<Display Example of Envelope Stacking Method>

As an example, during double-side printing, in the case where an envelope S with a flap Sa on the short side (for example, Long 3) is stacked on the manual feeding tray 11, the "stacking method during double-side printing" of this embodiment is shown in part (a) of FIG. 7, and the "stacking method during double-side printing" of a comparison example is shown in part (b) of FIG. 7. As shown in FIG. 7, the "stacking method during double-side printing" is represented by character information for illustrating the envelope stacking method with characters and by an envelope image including a direction (orientation) of the flap Sa of the envelope S and the front and back of the envelope S. Incidentally, in this embodiment, an example in which the stacking method of the envelope S is displayed in a state in which the flap Sa is closed (folded) is shown, but the stacking method of the envelope may also be displayed in a state in which the flap Sa is not closed.

As shown in part (a) of FIG. 7, in the case of this embodiment, the stacking method of the envelope S is displayed so that the address side (a flap Sa-formed side) of the envelope S is an upper surface side. In this case, during toner image fixing on the first side, the envelope S is fed along the feeding passage 601 so that the address side faces a side opposite from a guiding member 500 side (guiding member side) and so that a non-address side faces the guiding member 500 side (FIG. 1). On the other hand, as shown in part (b) of FIG. 7, in the case of the comparison example, the stacking method of the envelope S is displayed so that the address side (a side where the flap Sa is not formed) of the envelope S is an upper surface side. In this case, during toner image fixing on the first side, the envelope S is fed along the feeding passage 601 so that the non-address side faces a side opposite from a guiding member 500 side and so that the address side faces the guiding member 500 side (FIG. 1).

Incidentally, in the case where the envelope S is stacked in the stacking device 20 during double-side printing, the same display as the display of the "stacking method during double-side printing", i.e., the stacking method in which the address side of the envelope S is the upper surface side is displayed. On the other hand, in the case where the envelope S is stacked in the cassette 12 during double-side printing, the "stacking method during double-side printing" shown in part (b) of FIG. 7, not the "stacking method during double-side printing" shown in part (a) of FIG. 7, i.e., the stacking method in which the non-address side of the envelope S is the upper surface side is displayed. This is because as described above, the envelope S on the manual feeding tray 11 or in the stacking device 20 is fed to the secondary transfer portion T2 in a state in which the front and back of the envelope S is kept in the stacked state, but the envelope S in the cassette 12 is fed to the secondary transfer in a state in which the front and back of the envelope S is in a state reverse to the stacked state. As a result, even when the envelope S is stacked in (on) any stacking portion, the envelope S is fed during double-side printing so that the image is printed early on the address side as the first side.

Further, as shown in part (a) of FIG. 7, in the case where the stacking method is displayed so that the flap Sa extends along the direction crossing the feeding direction, the stacking method may preferably be displayed at the display portion 410 in a state in which the short side (flap side) where the flap exists is the leading end side with respect to the feeding direction. As a result, even when the curl occurs in the envelope S due to the automatic reversal, the envelope S can be caused to enter the fixing nip U while suppressing the deviation of the front and back of the envelope S. That is, the envelope S fed through the double-side feeding passage 600 (FIG. 1) for the double-side printing can be curled by being stiffened or the like when the envelope S passes through the bent path of the double-side feeding path 600. When the curl occurs in the envelope S, the envelope S swells in the neighborhood of the flap Sa, so that the front and back of the envelope S are liable to become an open state. In that state, during printing on the second side, when the envelope S enters the fixing nip U in the state in which the flap side is the leading end side with respect to the feeding direction, compared with the case where the curl does not occur, timing when the envelope S enters the fixing nip U deviates between the front and back of the envelope S, so that a speed difference is liable to occur between the front and back of the envelope S. When the speed difference occurs between the front and back of the envelope S, a slack (loosening) of the envelope S occurs. The slack occurring in the envelope S can increase on the non-flap side, which is the trailing end side with respect to the feeding direction, due to pressure with passing of the envelope S through the fixing nip U, and is finally liable to cause envelope crease. In order to prevent such envelope crease, the envelope S may preferably be displayed at the display portion 410 in the state in which the short side (flap side) where the flap Sa exists is the leading end side with respect to the feeding direction.

Next, a print state of the envelope S will be described using parts (a) and (b) of FIG. 8. In accordance with the "stacking method during double-side printing" in this embodiment, the case where the user stacks the envelope S on the manual feeding tray 11 and carries out the double-side printing was shown in part (a) of FIG. 8. Further, in accordance with the "stacking method during double-side printing" in the above-described comparison example, the case where the user stacks the envelope S on the manual feeding tray 11 and carried out the double-side printing was shown in part (b) of FIG. 8. Incidentally, in FIG. 8, the print state of the first side is shown on a left-hand side and the print state of the second side is shown on a right-hand side in the case where the images are printed on double sides of the envelopes of Long 3 and Western 3.

In the case of the comparison example shown in part (a) of FIG. 8, the image is printed early on the non-address side as the first side. During the printing on the first side (during the toner image formation), when the envelope S is sent to the secondary transfer portion T2 by the registration roller pair 14, oblique movement correction of the envelope S is properly performed by the registration roller pair 14, so that the envelope S enters the secondary transfer portion in a proper attitude. Accordingly, on the non-address side, characters such as a name of a sender and an address of the sender are printed properly without being obliquely printed. However, in the case where the characters (toner images) are fixed on the non-address side, as shown in the figure, distortion occurs in the envelope S after the fixing in some instances. Specifically, when the envelope S passes through the fixing nip U, the papers of the front and back of the envelope S are twisted due to an overlapping portion Sc of the envelope S and asymmetry of the envelope S, and the envelope S in a twisted state is pressed in the fixing nip U, so that the distortion occurs in the envelope S. Then, the envelope S is sent to the secondary transfer portion T2 in order to print the characters on the address side (second side), but when the distortion occurs in the envelope S, the oblique movement correction by the registration roller pair 14 is not performed properly, so that the envelope S does not enter the secondary transfer portion T2 in a proper attitude. As a result, as shown in the figure, on the address side, the postal code is deviated from the postal code field, and an addressee address and an addressee name (i.e., destination address (name)) can be obliquely printed largely.

On the other hand, in the case of this embodiment shown in part (b) of FIG. 8, the image is printed early on the address side as the first side. During the printing on the first side (during the toner image formation), the distortion does not occur in the envelope S, and therefore, the oblique movement correction of the envelope S is properly performed by the registration roller pair 14, so that the envelope S enters the secondary transfer portion in a proper attitude. Accordingly, as shown in the figure, on the address side (first side), the postal code falls within the postal code field and the characters of the destination address and name are printed properly without being obliquely printed. However, in the case where the characters (toner images) are fixed on the address side, as shown in the figure, distortion occurs in the envelope S after the fixing in some instances. Then, when the distortion occurs in the envelope S, the oblique movement correction by the registration roller pair 14 is not performed properly, so that the envelope S does not enter the secondary transfer portion T2 in a proper attitude. As a result, as shown in the figure, on the non-address side (second side), the addressee address and the addressee name can be obliquely printed. Thus, in the case where the characters are printed early on the address side, the characters are not readily obliquely printed on the address side but can be obliquely printed on the non-address side. However, compared in the case where the characters are obliquely printed on the address side which is liable to be conspicuous to user's eyes, when the characters are obliquely printed on the non-address side, such characters can be permitted from the viewpoints of appearance and the like.

As described above, in this embodiment, during double-side printing of the envelope S, when the stacking method of the envelope S stacked on the manual feeding tray 11, the cassette 12, the stacking device 20 and the like is displayed at the display portion 410, the stacking method such that the image is printed early on the address side as the first side of the envelope S was displayed. That is, on the address side of the envelope S, the image is preprinted in many instances, and therefore, the address side is required to have positional accuracy with the toner image to be formed compared with the non-address side. Further, on the address side, the destination address and name and the like are printed, so that the address side is required to be easy to see by the user. Therefore, compared with the case where the double-side printing is carried out using the non-address side as the first side, it is preferable that the double-side printing is carried out using the address side as the first side on which the envelope S is capable of entering the secondary transfer portion T2 in a proper attitude. For that purpose, in this embodiment, as the "stacking method during double-side printing" of the envelope S, the stacking method in which the image is printed early on the address side as the first side of the envelope S is displayed at the display portion 410.

Incidentally, as shown in parts (a) and (b) of FIG. 8, in the case of the envelope S with the flap Sa on the short side, the stacking method of the envelope S may preferably be displayed at the display portion 410 so that the flap Sa extends along the direction crossing the feeding direction.

On the other hand, as shown in parts (a) and (b) of FIG. 8, in the case of the envelope S with the flap Sa on the long side, the stacking method of the envelope S may preferably be displayed at the display portion 410 so that the flap Sa extends along the feeding direction. That is, the stacking method of the envelope S at the display portion 410 may also be changed depending on a kind (size) and the like of the envelope S.

OTHER EMBODIMENTS

Incidentally, in the above-described embodiment, the image forming apparatus 100 of the lateral (horizontal) feeding type was described as an example, but the present invention is not limited thereto. The image forming apparatus to which the above-described controller 300 is applicable may also be an image forming apparatus of a vertical feeding type. An image forming apparatus 100A of the vertical feeding type is shown in FIG. 9. The image forming apparatus 100A of the vertical feeding type shown in FIG. 9 is largely different from the above-described image forming apparatus 100 of the lateral feeding type principally in the automatically reversing mechanism. Therefore, in this embodiment, constituent elements similar to those of the image forming apparatus of the lateral feeding type are represented by the same reference numerals or symbols (FIG. 1) and will be briefly described or omitted from description. Incidentally, in FIG. 9, as regards the image forming portions PY to PK, for convenience of illustration, the reference numerals or symbols are added only to the constituent elements of the image forming portion PK for black.

In the case of the vertical feeding type shown in FIG. 9, the envelope S in the cassette 12 (corresponding to the first stacking portion) is fed to the secondary transfer portion T2 so that the toner image is formed on the upper surface side thereof, and the envelope S on the manual feeding tray 11 or in the stacking device 20 (corresponding to the second stacking portion) is fed to the secondary transfer portion T2 so that the toner image is formed on the lower surface side. Further, in the case of the one-side printing, the envelope S on which a first side the toner image is fixed is discharged by the discharging roller pair 15 onto the discharge tray 602 provided at the upper portion of the apparatus main assembly 100*a*. On the other hand, in the case of the double-side printing, the envelope S on which the first side the toner image is fixed is fed to the discharging roller pair 15 which is normally rotated, and thereafter at timing when the trailing end passed through a flapper 18 is fed to the double-side feeding passage 600 by the discharging roller pair 15, which is reversely rotated, in a switch back manner. Thus, the leading and trailing ends of the envelope S are changed to each other by the reverse rotation of the discharging roller pair 15, and the envelope S is fed toward the registration roller pair 14 through the double-side feeding passage 600 and the feeding passage 601. In the case of the image forming apparatus 100A of the vertical feeding type, a portion constituted by the double-side feeding passage 600, the discharging roller pair 15 and the flapper 18 are an example of the automatically reversing mechanism for automatically reversing the envelope S.

In the case of the image forming apparatus 100A of the vertical feeding type, a stacking method of the envelope S displayed at the display portion 410 with execution of the display control process (FIG. 6) by the controller 300 is as shown in parts (a) and (b) of FIG. 7 described above.

However, the "stacking method during double-side printing" in the case where the envelope S is stacked in the cassette 12 is a display example shown in part (a) of FIG. 7, and the "stacking method during double-side printing" in the case where the envelope S is stacked on the manual feeding tray 11 or in the stacking device 20 is a display example shown in part (b) of FIG. 7. That is, these display examples are changed from those of the case of the image forming apparatus 100 of the lateral feeding type.

That is because, the image forming apparatus 100A of the vertical feeding type and the image forming apparatus 100 of the lateral feeding type are different in the feeding manner of the envelope S, and therefore, the stacking method of the envelope S in the case of the vertical feeding type and the stacking method of the envelope S in the case of the lateral feeding type are different in the front and back of the envelope S.

As a result, even in the case of the image forming apparatus 100 of the vertical feeding type, in accordance with the "stacking method during double-side printing", even when the envelope S is stacked on any magnetic portion, the image is printed early on the address side as the first side. Accordingly, on the address side (first side), the postal code falls within the postal code field, and the characters of the destination address and name are properly printed without being obliquely printed.

Incidentally, in the above-described embodiments, the image forming apparatus in which during double-side printing, the envelope S is automatically reversed by the automatically reversing mechanism and the images are printed on the double sides of the envelope S was described as an example, but the present invention is not limited thereto. The above-described controller 300 is also applicable to the case of an image forming apparatus in which a reversing operation of the envelope S is manually performed by the user. In the manually reversing operation of the envelope S, the envelope S on which the toner image is fixed on the address side as the first side is once discharged on the discharge tray 602 (FIG. 1). Thereafter, the user turns the discharged envelope S upside down and sets the envelope S on the manual feeding tray 11 again, and then starts printing of the toner image on the non-address side as the second side.

For example, in the case where double-side printing of an envelope S having a large basis weight and high rigidity is carried out, there is a liability that such an envelope S cannot be automatically reversed by the double-side feeding passage 600, and therefore, in order to reverse such an envelope S, manual reversal by the user is carried out. For that purpose, on an input screen, the "manual double-side (printing) key 415" by which the user can select the manual reversal during double-side printing of the envelope S is displayed (FIG. 5). That is, the controller 300 controls the image forming apparatus 100 so that the manual reversing operation is performed by operating the "manual double-side key 415" by the user. Incidentally, as an example, whether or not the printing of the envelope S should be carried out through the manual reversal by the user's operation of the "manual double-side key 415" is made selectable, but the present invention is not limited thereto. For example, whether or not the double-side printing of the envelope S should be carried out may also be made selectable on the basis of the size, the basis weight or the like of the envelope S. Further, for example, in order to cause the user to manually turn the discharged envelope S upside down and then to properly set the envelope S on the manual feeding tray 11, after the envelope S for which the printing of the image on the address side is ended is discharged, the display of the stacking method of the envelope S may be switched to the display of the stacking method of the envelopes in which the non-address side is the upper surface side (part (b) of FIG. 7). Further, in this case, after address side printing of the images is successively carried out on a plurality of envelopes S, non-address side printing of the images can be successively carried out on the envelopes S on which the images have already been printed on their address sides.

Incidentally, in the case where as the stacking method of the envelope S, the envelope image is displayed at the display portion 410 (part (a) of FIG. 7), as regards the envelope image, image data of the envelope S actually read by the original reading device 90 may also be displayed. In that case, the controller 300 automatically recognizes preprint information (such as e a postal code field Sb, the logo and advertisement of the enterprise, and the like) which have already been printed on the envelope S read by the original reading device 90, and then image data of the envelope S with the address side which is the preprint side may be stored in the memory 302. Further, in the case of an envelope S with the postal code field Sb which has already been printed, the stacking method of the envelope S may preferably be displayed at the display portion 410 so that the postal code field Sb side is the leading end side with respect to the feeding direction (part (a) of FIG. 8). In the case where the postal code field Sb exists on the leading end side with respect to the feeding direction, the postal code is printed in advance of the address and the like, and therefore, this case is advantageous since the postal code is not readily printed in the state in which the postal code is deviated from the postal code field Sb, and is not readily printed obliquely in the postal code field Sb.

Incidentally, in the above-described embodiment, the image forming apparatus having the constitution in which the toner images of the respective colors are primary-transferred from the photosensitive drums 1Y to 1K for the colors onto the intermediary transfer belt 8, and then the composite toner images are collectively secondary-transferred onto the envelope S was described, but the present invention is not limited thereto. For example, an image forming apparatus of a direct transfer type in which the toner images are directly transferred from the photosensitive drums 1Y to 1K onto the envelope S may also be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-200392 filed on Oct. 24, 2018, which is hereby incorporated by reference herein in its entirety.

What is claimed is:

1. An image forming apparatus comprising:

an image forming portion capable of forming a toner image on an envelope including a flap and capable of executing an operation in a one-side mode in which an image is formed on one side of a recording material and an operation in a double-side mode in which images are formed on double sides of the recording material;

a stacking portion configured to stack the envelope fed to said image forming portion;

a fixing portion configured to fix the toner image on the envelope, on which the toner image is formed by said image forming portion, by heating and pressing the envelope;

a display portion configured to display information; and a controller configured to control said display portion so that when the double-side mode in which the images are formed on the double sides of the envelope is selected, a stacking method in which the envelope is stacked on said stacking portion so as to fix the image on a flap-formed side when the envelope first passes through said fixing portion is displayed at said display portion.

2. An image forming apparatus according to claim 1, wherein said controller causes said display portion to display the stacking method of the envelope so that when said stacking portion is a first stacking portion from which the envelope is fed to said image forming portion, said flap-formed side is an upper surface side of the envelope, and so that when said stacking portion is a second stacking portion from which the envelope is fed to said image forming portion, said flap-formed side is a lower surface side of the envelope so as to permit formation of the toner image on the lower surface side of the envelope stacked on said stacking portion.

3. An image forming apparatus according to claim 1, wherein said controller causes said display portion to display the stacking method of said envelope so that said flap-formed side is an upper surface side of the envelope when the envelope is stacked on a manual feeding tray and so that said flap-formed side is a lower surface side of the envelope when the envelope is stacked on a cassette.

4. An image forming apparatus according to claim 1, wherein said controller causes said display portion to display a screen for selecting a kind of the envelope.

5. An image forming apparatus according to claim 1, wherein said controller causes said display portion to display a screen for selecting double-side printing.

6. An image forming apparatus comprising:

an image forming portion capable of forming a toner image on an envelope including a flap and capable of executing an operation in a one-side mode in which an image is formed on one side of a recording material and an operation in a double-side mode in which images are formed on double sides of the recording material;

a stacking portion configured to stack the envelope fed to said image forming portion;

a fixing portion configured to fix the toner image on the envelope, on which the toner image is formed by said image forming portion, by heating and pressing the envelope;

a display portion configured to display information; and a controller configured to control said display portion so that when the double-side mode in which the images are formed on the double sides of the envelope is selected, a stacking method in which the envelope is stacked on said stacking portion so as to fix the image on an address print side when the envelope first passes through said fixing portion is displayed at said display portion.

7. An image forming apparatus according to claim 6, wherein said controller causes said display portion to display the stacking method of the envelope so that when said stacking portion is a first stacking portion from which the envelope is fed to said image forming portion, said address print side is an upper surface side of the envelope, and so that when said stacking portion is a second stacking portion from which the envelope is fed to said image forming portion, said address print side is a lower surface side of the envelope so as to permit formation of the toner image on the lower surface side of the envelope stacked on said stacking portion.

8. An image forming apparatus according to claim 6, wherein said controller causes said display portion to display the stacking method of said envelope so that said address print side is an upper surface side of the envelope when the envelope is stacked on a manual feeding tray and so that said address print side is a lower surface side of the envelope when the envelope is stacked on a cassette.

9. An image forming apparatus according to claim 6, wherein said controller causes said display portion to display a screen for selecting a kind of the envelope.

10. An image forming apparatus according to claim 6, wherein said controller causes said display portion to display a screen for selecting double-side printing.

* * * * *